United States Patent [19]

Metzinger

[11] Patent Number: 5,068,960

[45] Date of Patent: Dec. 3, 1991

[54] DEVICE FOR THE INSERTION OF FILLING WIRES INTO A WIRE JOINTED-BAND

[75] Inventor: Friedrich Metzinger, Frankfurt am Main, Fed. Rep. of Germany

[73] Assignee: Filztuchverwaltungs GmbH, Morfel Den-Walldorf, Fed. Rep. of Germany

[21] Appl. No.: 460,752

[22] Filed: Jan. 4, 1990

[30] Foreign Application Priority Data

Mar. 4, 1989 [DE] Fed. Rep. of Germany ... 8902635[U]

[51] Int. Cl.[5] ..... B23P 19/04

[52] U.S. Cl. ..... 29/779; 29/241; 29/819; 29/821; 29/822; 226/108; 226/168; 226/196

[58] Field of Search ..... 29/241, 728, 779, 819, 29/821, 822, 433; 226/108, 168, 196; 72/428

[56] References Cited

U.S. PATENT DOCUMENTS

| | | | |
|---|---|---|---|
| 3,567,097 | 3/1971 | Baker et al. | 72/428 X |
| 4,103,417 | 8/1978 | Hoffman et al. | 29/433 X |
| 4,290,209 | 9/1981 | Buchanan et al. . | |
| 4,362,776 | 12/1982 | Lefferts et al. | 29/433 X |
| 4,423,543 | 1/1984 | Leuvelink | 29/241 X |
| 4,459,733 | 7/1984 | Bachman et al. | 29/433 |
| 4,477,959 | 10/1984 | Burnecke et al. | 29/241 X |
| 4,750,253 | 6/1988 | Bleher et al. | 29/241 X |
| 4,920,638 | 5/1990 | Metzinger | 29/786 |

FOREIGN PATENT DOCUMENTS

| | | |
|---|---|---|
| 0050374 | 10/1981 | European Pat. Off. . |
| 0216215 | 9/1986 | European Pat. Off. . |
| 2419751 | 12/1975 | Fed. Rep. of Germany . |
| 3221255 | 12/1983 | Fed. Rep. of Germany . |
| 3523144 | 11/1986 | Fed. Rep. of Germany . |
| 2847327 | 1/1990 | Fed. Rep. of Germany . |

*Primary Examiner*—Mark Rosenbaum
*Assistant Examiner*—Frances Chin
*Attorney, Agent, or Firm*—Oldham & Oldham Company

[57] ABSTRACT

A device for the insertion of filling wires into a wire jointed-band is described, being positioned in the conveying direction of a machine for the production of the wire jointed-band behind a feeding device for the plugging wires. By means of a guiding plate with channels and a roller the filling wires are inserted into the respective openings of the already completed wire jointed-band. The device according to the invention allows a sectional mechanical insertion of the filling wires into the actual wire jointed-band. The filling wires can be inserted simultaneously with the plugging wires, resulting in a substantially higher production speed.

9 Claims, 4 Drawing Sheets

Fig.4
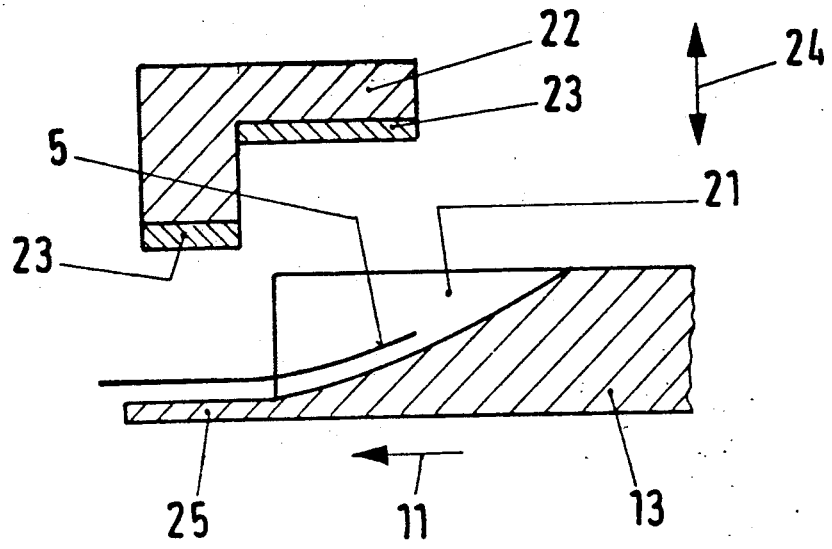
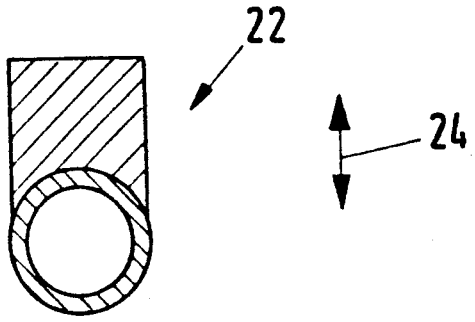
Fig.5
Fig.6
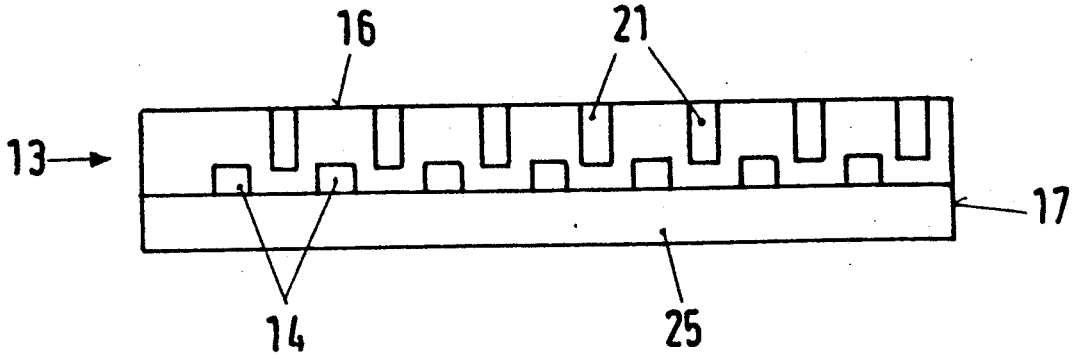

DEVICE FOR THE INSERTION OF FILLING WIRES INTO A WIRE JOINTED-BAND

BACKGROUND ON THE INVENTION

The invention relates to a device for the insertion of filling wires into openings of a wire jointed-band which is constructed of alternating counter-current wound spirals and spirals overlapping each other being provided next to each other. A common pairwise connection opening formed at the overlapping locations accommodates a plugging wire which is inserted. In the construction of the wire jointed-band, the filling wires are inserted to extend parallel to the plugging wires.

Such wire jointed-bands have proved to be useful. There is often the requirement that the relatively large openings of the wire jointed-band are partly closed in order to decrease the rate of air flow therethrough on fast running machines. This is accomplished in a known manner by means of the filling wires which correspondingly decrease the free cross sectional area of the wire jointed-band.

A machine for the production of such wire jointed-bands which may also be utilized in the device according to the invention is described in the U.S. Pat. No. 4,920,638 of the applicant. With regard to prior art, DE-PS 35 23 149 describes a similar machine which includes additional means for the insertion of filling wires. This device is also provided with a press pad for inserting the filling wires. However, in this patent, the mechanism or apparatus for inserting the filling wires is not disclosed and possibly the filling wires are even inserted manually into the actual wire jointed-bands.

A device in which the filling wires can be inserted mechanically is described in EP-PS 50 374. In this, however the filling wires are inserted into one single wire spiral and only then the wire spirals are connected with each other by means of plugging wires to the wire jointed-band. Feeding of the filling wires to the spiral is made by a pair of driven rollers.

Additionally in the prior art, DE-PS 32 21 255 describes such a wire jointed-band with filling wires, however, without stating how the filling wires are inserted into the wire jointed-band.

A similar prior art wire jointed-band also gives no indication of how mechanical insertion of the filling wires into the wire jointed-band can be accomplished is described in DE-PS 24 19 751.

Also in DE-PS 28 47 327 the advantages have been pointed out which are obtained by the filling wires in such wire jointed-bands, however, no device is described which would enable a mechanical insertion of the filling wires into the wire jointed-band.

SUMMARY OF THE INVENTION

A main object of the invention therefore is to propose a device which makes a mechanical insertion of the filling wires into the wire jointed-band possible.

The device according to the invention shall be reliable in operation at high production speeds without producing scrap.

For accomplishing this object the invention is characterized by a guiding plate with several channels parallel to each other for guiding the filling wires, wherein the channels over a section of the guiding plate are freely accessible from above and below. A conveyor roller is driven for rotation in the area of the above-mentioned section of the guiding plate to act upon the filling wires in the channels, thereby transporting the wires to the openings of the wire jointed-band thereby inserting them into for insertion into these openings. Furthermore, at the side of the guiding plate in the direction of the wire jointed-band are provided several slots next to each other and freely accessible from above for inserting and fixing the ends of the plugging wires protruding over the wire jointed-band. The slots are arranged in such a way that above the fastening of the plugging wires in the slots, the wire jointed-band is aligned to the orifices of the channels in such a manner that the openings serving for the reception of the filling wires of the wire jointed-band are lying opposite to the orifices of the channels.

Thus the filling wires are inserted into the rear channels of the guiding plate, usually by hand. For this, suitable storage containers are provided for the winding coils of the filling wires. The filling wires are of suitable size with a corresponding cross-section according to the desired filling rate of the wire jointed-band. After insertion of the filling wires into the guiding plate, the conveying roller is rotated to transport the filling wires in the channels and into the respective openings of the actual wire jointed-band. The wires are then fixed in the correct position by means of the slots relative to the orifices of the guiding plate in such a way that the filling wires are pushed into the correct, coordinated openings of the wire jointed-band. It is to be mentioned that at the respective side edge of the wire jointed-band the plugging wires may protrude over the edge of the wire jointed-band, and these protruding ends of the plugging wires are used for fixing of the wire jointed-band relative to the guiding plate and to the device according to the invention, respectively.

It should be understood that one also could use the device for feeding of the plugging wires as the device will be provided in the machine for feeding the filling wires into the openings of the wire jointed-band after the plugging wires have been inserted. For this purpose, the device would have only to be displaced by a respective distance so that the filling wires are inserted into the correct openings. However, the invention intentionally is not directed to this because this would decrease the production speed achievable because first of all the plugging wires and subsequently the filling wires would have to be inserted into the openings. Another important disadvantage would be that only the plugging wires could be used for the filling wires which would result in only a certain filling rate. One would not be free in the choice of the cross-section and cross-sections, respectively of the filling wires. These disadvantages are avoided with the device according to the invention which intentionally provides an independent separate device.

In order to facilitate the insertion and fixing of the free ends of the plugging wires in the slots it is preferred that a press pad is provided to be turned on and off which will press the ends of the plugging wires inserted into the slots and onto the supporting plate of the guiding plate in front of the orifices.

The press pad can also be provided as rubber ledge and then the profile of the press pad is automatically adapting itself to the profile of the guiding plate with its supporting plate. Alternatively, the press pad also can be provided as a respectively profiled pressing plate the bottom side of which could be coated with rubber material for careful and effective pressing of the ends of the plugging wires into the slots.

In front of the guiding plate there may also be provided a guiding roller driven for rotation with front flanges protruding over its profile for systematic feeding of the filling wires to the guiding plate, on the upper side of which the filling wires are supported. The drive of this guiding roller and of the feed roller is preferably common and between both rollers a suitable gearing is provided.

The described machine for the production of the wire jointed-band is preferably supplemented by the device according to the invention in such a way that the device is positioned in the transporting direction of the wire joint-band behind the device for the feeding of the plugging wires, preferably at the same side. However, the device also may be provided at the other side, opposite the side of the device.

BRIEF DESCRIPTION OF THE DRAWINGS

The invention is further explained in an embodiment resulting in further important features. In the drawings are shown in FIG. 1 shows in plan view a partial view of the machine including the device according to the invention;

FIG. 4 shows an enlarged side view according to FIG. 3 the front end of the guiding plate with press pad and end of the plugging wire inserted into one of the slots;

FIG. 5 shows a modified embodiment of the press pad; and

FIG. 6 shows a front view of the orifices and of the slots of the guiding plate in a view in the direction of arrow B of FIG. 3.

DETAILED DESCRIPTION OF THE INVENTION

Figure 1:
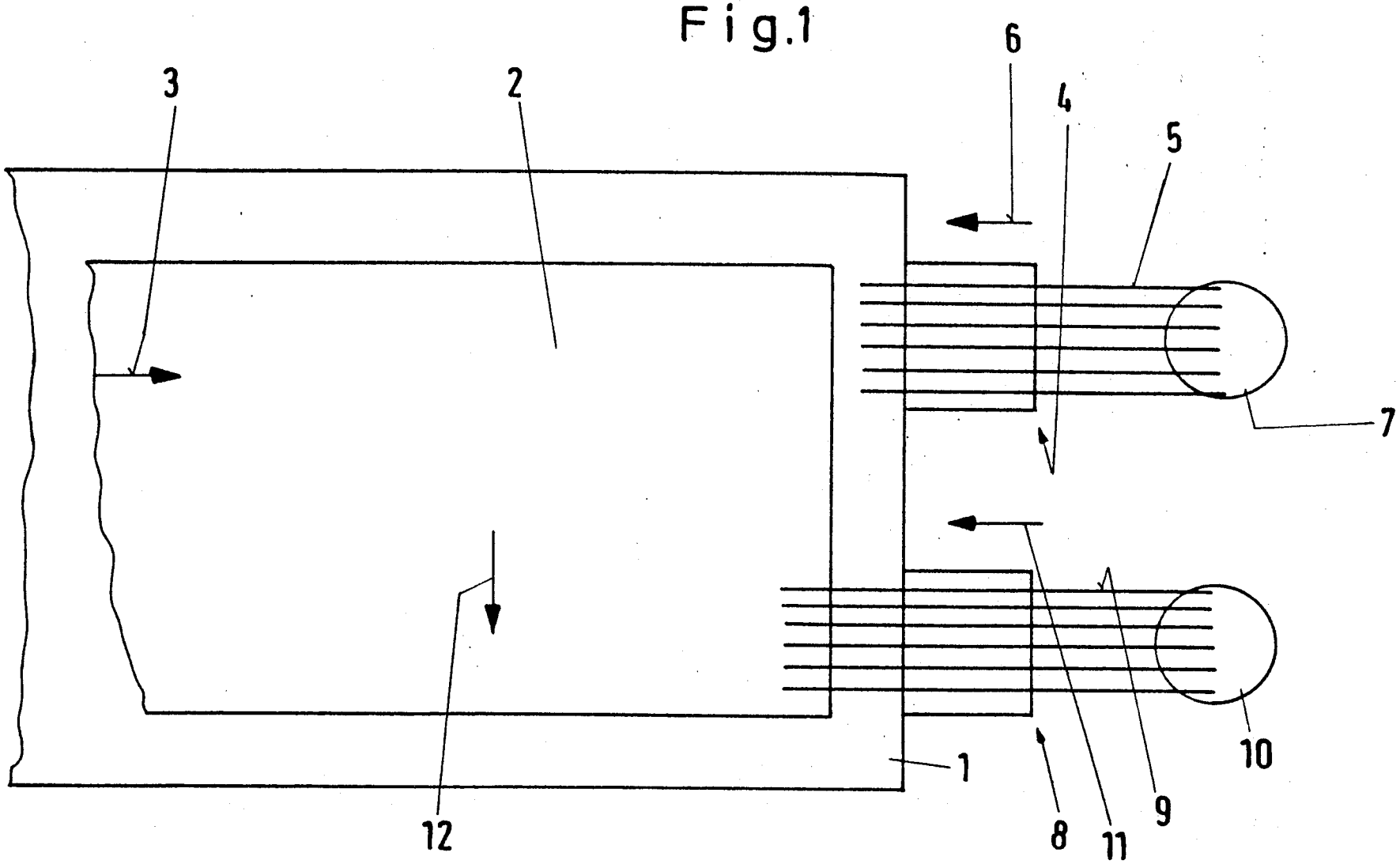

FIG. 1 shows a working table 1 on which (in the drawing broken at lefthand) a piece of a wire jointed-band is supported. Principally, the wire jointed-band is produced in such a way that spirals partly pushed into each other are fed in the direction of arrow 3 toward device 4. The device 4 inserts the plugging wires 5 in the direction of arrow 6 into the respective pairwise openings (not shown) of the spirals which partly are overlapping each other. For this, a suitable drive (not shown) for the plugging wires 5 is provided, e.g. a driven pair of rollers as known per se. Moreover, a storage container 7 for the plugging wires is indicated.

By means of the described device, wire jointed-bands can be produced as described for example in U.S. Pat. No. 4,920,638 of the applicant.

It was already mentioned that these wire jointed-bands in many applications have to be provided with filling wires. The device according to the invention which is indicated as a whole in FIG. 1 at position 8 accomplishes this aspect both quickly an efficiently. By means of this device filling wires 9 are transported from a storage container 10 in the direction of arrow 11 to wire jointed-band. They are inserted in the front side of the openings of the wire jointed-band.

The machine is working in such manner that after insertion of a set of plugging wires 5 into the completed wire jointed-band in the direction of arrow 12, i.e. at right angle to arrows 3, 6, and 11, transporting is made intermittently so that also a set of filling wires 9 can be inserted into the wire jointed-band. The devices 4 and 8 therefore are processing the same number each of wires 5 and 9, respectively.

Figure 2:
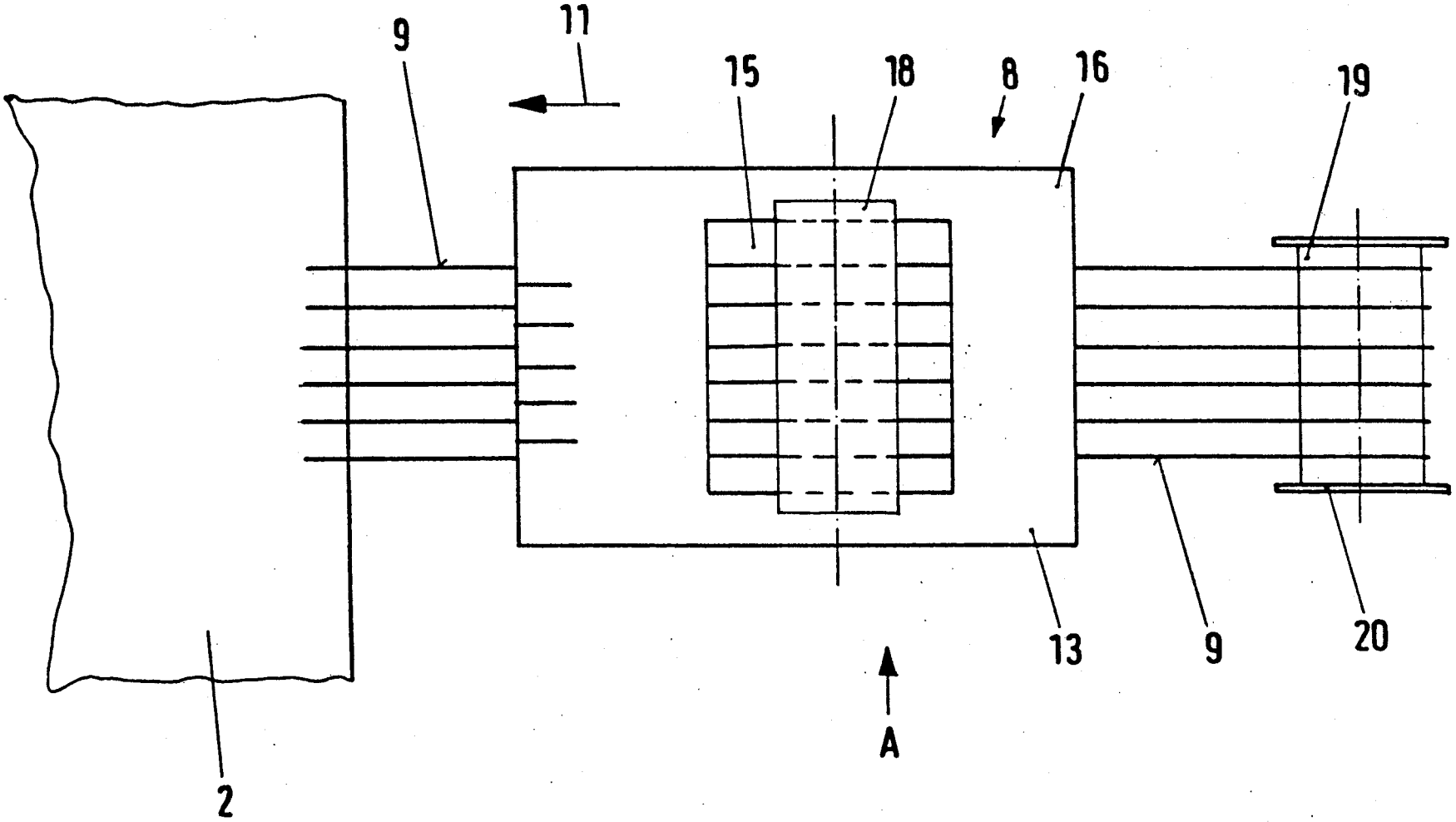
FIG. 2 shows an enlarged plan view compared to FIG. 1, the device according to the invention in its cooperation with an end of the wire jointed-band.

In the following the construction of the device 8 according to the invention is further explained by the further figures. FIG. 2 is showing that a guiding plate 13 having channels passing therethrough in the longitudinal direction, for receiving and guiding the filling wires 9. FIG. 6 is showing the orifices 14 of the channels directed to the wire jointed-band 2.

The guiding plate 13 consists of a lower smooth part of the plate and an upper part of the plate out of which a window-like opening 15 is cut. Moreover, the channels 14 are provided in the bottom side of upper plate 16. It should be understood that the channels 14 also can be provided in the upper side of lower plate 17.

Directly above the window-like opening 15 is a conveying roller 18 driven for rotation, preferably made of rubber material or with a rubber coating so that roller 18 can transport the filling wires freely accessible through the window 15 in the direction of arrow 11. This aspect is more clearly seen with respect to FIG. 3 wherein the filling wire 9 and roller 18 are spaced from each other.

Before guiding plate 13 a guiding roller 19 with protruding flanges 20 may be provided which is also driven in the direction of arrow 11.

As seen in FIG. 6, the gaps between orifices 14 at the end of the guiding plate 13 which is directed toward the wire jointed-band 2 may be provided with freely accessible slots 21. The slots 21 act to allow the free ends of plugging wires 5 to be inserted and clamped there. For this, a press pad 22 serves to clamp the free ends and may have a rubber coating 23 at its bottom side according to FIG. 4 and which in this embodiment is formed according to the profile of the guiding plate 13. In the embodiment according to FIG. 5 the press pad 22 consists of a rubber ledge. It can be engaged and lifted off, respectively, in the direction of double arrow 24.

Figure 3:
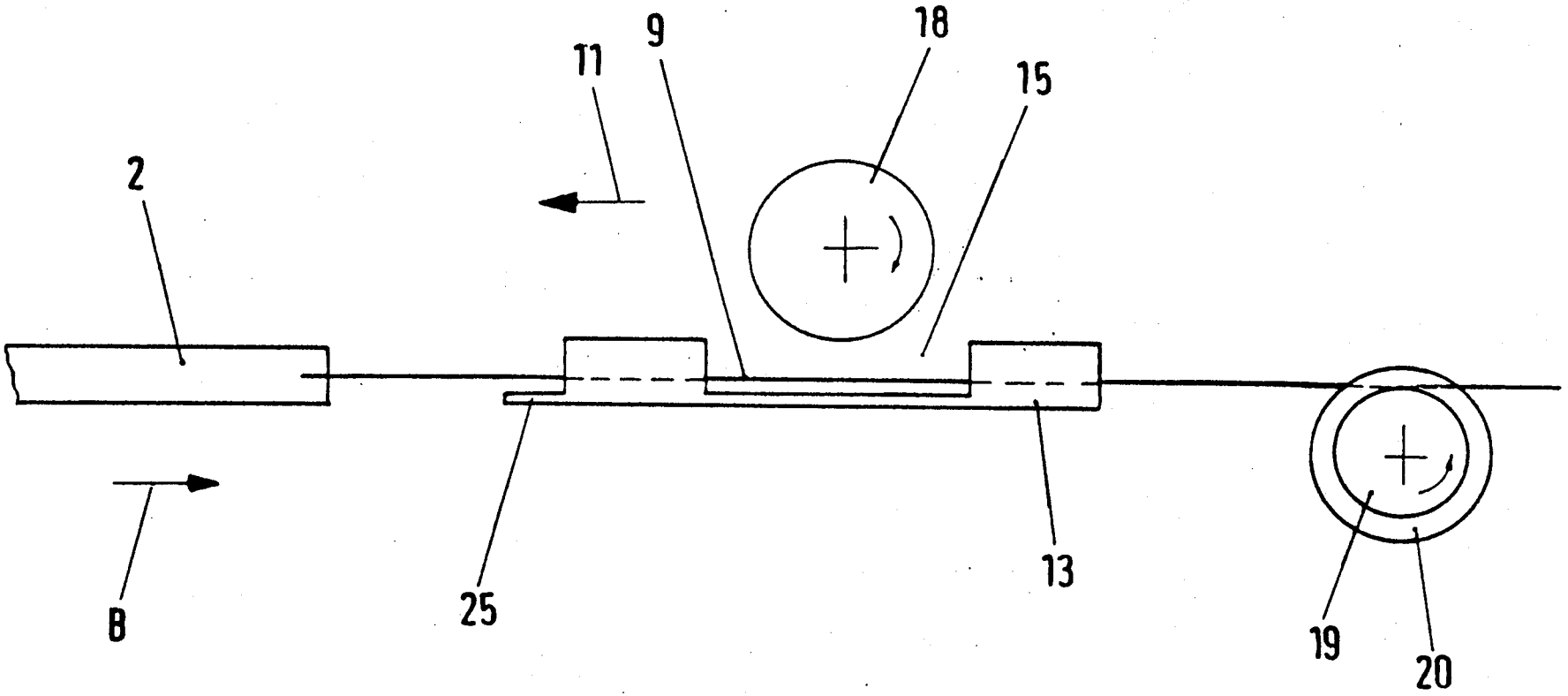
FIG. 3 shows a cross-sectional view in the direction of arrow A of FIG. 2.

Additionally, as seen in FIGS. 3, 4 and 6, the guiding plate 13 ends in a supporting plate 25 for the plugging wires.

It is obvious that by the arrangement of slots 21 relative to the orifices 14 the band 2 is correctly positioned in respect to the device 8 according to the invention, pushing the filling wires 9 without further manipulation into the correct cooperating openings of the wire jointed-band 2.

The filling wires can be inserted simultaneously with the plugging wires, resulting in a considerably higher production speed.

What is claimed is:

1. A device (8) for the insertion of filling wires (9) into openings of a formed wire jointed-band, wherein said wire jointed-band is constructed of counter-current wound spirals which partly overlap each other being provided next to each other forming pairwise connection openings in which a plugging wire (5) is inserted wherein the filling wires extend parallel to the plugging wires in the wire jointed-band the device comprising a guiding plate (13) with front and rear ends and having a plurality of channels (14) forming orifices which are parallel to each other, said channels provided for guiding the filling wires (9), wherein the channels over a section (15) of the guiding plate (13) are freely accessible from above and below, and a conveyor roller (18) driven for rotation in the area of said section (15) acts upon the filling wires (9) in the channels (14) so as to transport said filling wires to said openings of the wire jointed-band (2) for insertion into said openings wherein furthermore at the side of said guiding plate (13) in the direction toward the wire jointed-band (2) are provided a plurality of slots (21) next to each other and freely accessible from above and provided for inserting and fixing the ends of the plugging wires (5) protruding over the wire jointed-band (2), said slots being arranged relative to the orifices of said channels such that upon fastening of the plugging wires (5) in said slots (21) the openings of the wire jointed-band (2) are aligned to the orifices (14) of said channels (14) to receive the filling wires therein.

2. The device according to claim 1, further comprising a press pad (22) to be turned on and off for pressing the plugging wire ends (5) inserted into slots (21) into the slots (21) and onto a supporting plate (25) of the guiding plate (13) in front of the orifices of said channels (14).

3. The device according to claim 2, wherein said press pad (22) is provided as a rubber ledge.

4. The device according to claim 2, wherein said press pad (22) is provided as a pressing plate having the profile of the front end of the guiding plate including said supporting plate.

5. The device according to claim 1, wherein there is provided in front of the guiding plate (13) a guiding roller (19) driven for rotation with front end flanges (20) protruding over its profile on the upper side of which the filling wires (9) are supported.

6. The device according to claim 1 wherein said device is used with a machine for the production of wire jointed-bands (2) having a working table (1) for the support of the wire jointed-band (2), characterized in that the device (8) for the insertion of the filling wires is positioned in the transporting direction (12) of the wire jointed-band behind the device (4) for feeding of plugging wires (5).

7. A device for the insertion of filling wires into a formed wire jointed-band being constructed of countercurrent wound spirals which partly overlap each other to form pairwise connection openings in which a plugging wire is inserted to connect said spirals, said wire jointed-band having other openings into which said filling wires are to be inserted, the device comprising:

a guiding plate having front and rear ends and being formed with a plurality of channels which are parallel to one another and provided for guiding said filling wires, wherein said channels are freely accessible from above and below over a section of said guiding plate, a roller means positioned over said section of said guiding plate and contacting said filling wires within said channel so as to transport said filling wires for insertion into said openings of said wire jointed-band, a plurality of slots provided on said guiding plate in a position adjacent said wire jointed-band, wherein said slots are provided for inserting and fixing ends of said plugging wires extending from said wire jointed-band, wherein said slots are arranged relative to said channels of said guiding plate such that upon fastening of said plugging wires in said slots, said openings of said wire jointed-band will be aligned with said channels such that said filling wires guided by said channels will be directed toward said openings to be inserted into said wire jointed-band.

8. The device according to claim 7, wherein, said device for the insertion of filling wires is used in conjunction with an apparatus for forming said wire jointed-band which includes a working table for the support of said wire jointed-band and an apparatus for insertion of said plugging wires into said wire jointed-band, wherein the device for insertion of said filling wires is positioned in a direction substantially perpendicular to the direction at which said plugging wires are inserted into said wire jointed-band, and the formed wire jointed-band is moved or said working table to the position of the device for the insertion of said filling wires to enable said openings of said formed wire jointed-band to receive said filling wires.

9. The device according to claim 7, further comprising a press pad to be turned on or off for pressing said ends of said plugging wires into said slots of said guiding plate and onto a supporting plate of said guiding plate in front of said channels of said guiding plate.

* * * * *